US006816696B2

(12) United States Patent
Nishizawa et al.

(10) Patent No.: US 6,816,696 B2
(45) Date of Patent: Nov. 9, 2004

(54) IMAGE FORMING APPARATUS PROVIDED WITH DEVELOPING DEVICE USING MAGNETIC BRUSH DEVELOPING METHOD

(75) Inventors: Kimio Nishizawa, Hachioji (JP); Yutaka Miyasaka, Machida (JP); Nobuyasu Tamura, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/367,427

(22) Filed: Feb. 14, 2003

(65) Prior Publication Data

US 2003/0161666 A1 Aug. 28, 2003

(30) Foreign Application Priority Data

Feb. 25, 2002 (JP) ..... 2002-047720

(51) Int. Cl.[7] ..... G03G 15/09
(52) U.S. Cl. ..... 399/270; 399/274
(58) Field of Search ..... 399/270, 274

(56) References Cited

U.S. PATENT DOCUMENTS 4,676,192 A * 6/1987 Yuge et al.
5,621,506 A * 4/1997 Hosaka et al.
6,287,740 B2 * 9/2001 Ohmura et al.

* cited by examiner

*Primary Examiner*—Arthur T. Grimley
*Assistant Examiner*—Ryan Gleitz
(74) *Attorney, Agent, or Firm*—Frishauf, Holtz, Goodman & Chick, P.C.

(57) ABSTRACT

In an image forming apparatus including a developing device, an inequality of $1 \leqq (\alpha/100) \times Vr \times Hr^{1/3} < 3.5$ is satisfied, wherein Vr denotes the peripheral speed ratio of an outer circumferential surface of a developer carrying member to the outer circumferential surface of an image carrying member, Hd denotes a spacing of the outer circumferential surface of the developer carrying member to the outer circumferential surface of the image carrying member, Hh denotes an average value of a height of a magnetic brush layer, Hr denotes a ratio of an average value of the height Hh to the spacing Hd, and $\alpha$ (%) denotes a coverage ratio of an area of the magnetic brush layer to cover the outer circumferential surface of the developer carrying member to the outer circumferential surface of the developer carrying member.

2 Claims, 6 Drawing Sheets

FIG. 4 ( a )
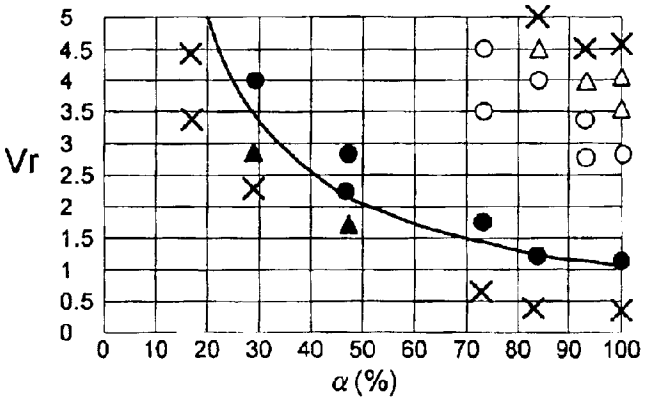
FIG. 4 ( b )
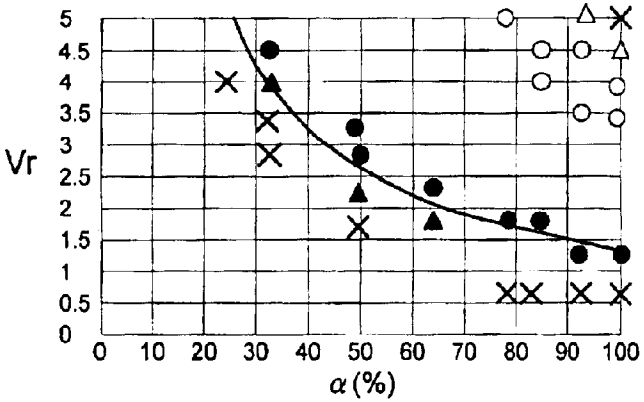
FIG. 4 ( c )
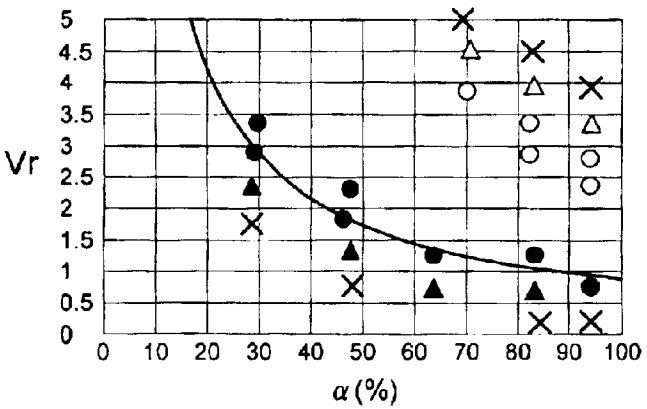
FIG. 4 ( d )
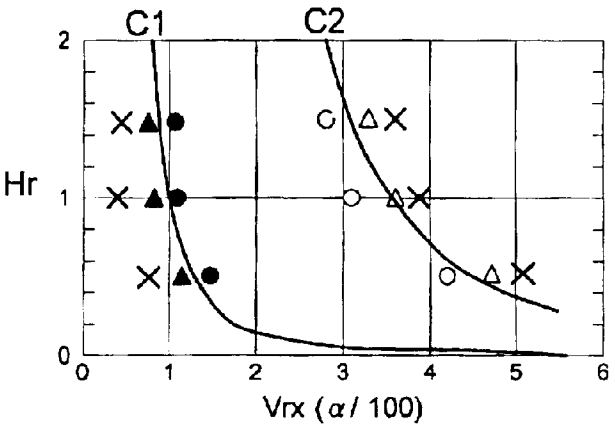

IMAGE FORMING APPARATUS PROVIDED WITH DEVELOPING DEVICE USING MAGNETIC BRUSH DEVELOPING METHOD

BACKGROUND OF THE INVENTION

The present invention relates to an image forming apparatus provided with a developing device based on an electrophotographic method, and in particular, to an image forming apparatus provided with a developing device using a magnetic brush developing method in which development is carried out by the use of two-component developer composed of a magnetic carrier and a non-magnetic toner.

In a conventional magnetic brush developing method using a two-component developer composed of a magnetic carrier and a non-magnetic toner, from the necessity of securing a good developability causing no deficient density, it has been required to supply a sufficient amount of the developer within a range not to produce a problem of the spilling of the developer or the adhering of the carrier particles, in the development region where the magnetic brush layer composed of the developer formed on the outer circumferential surface of a developer carrying member (also called a developing sleeve) is in contact with or close to the outer circumferential surface of an image carrying member (also called a photoreceptor).

For this reason, it has been generally used a developing device using a value near 100% as the coverage ratio (to be described later) of a magnetic brush layer to cover the outer circumferential surface of a developer carrying member.

Further, for the purpose of securing the image density of solid areas, it has been used a method in which the speed ratio of the developer carrying member to the image carrying member was set at a high value, and developer of an amount as much as possible was made to pass the development region while a latent image was passing the region.

However, in recent years, requirement for obtaining a color image and a higher image quality has been enhanced, and now it is necessary a technology for obtaining a toner image which is uniform even in a half-tone area, that is, in a weak electric field area.

However, in a conventional magnetic brush developing method, when a half-tone image is formed, it frequently occurred that image defects such as unevenness of density and scratches in the edge portions were produced.

These image defects are phenomena which occur because a toner image once formed on the photoreceptor drum is rubbed and disturbed by the magnetic brush layer under the somewhat excessive rubbing action of the magnetic brush on the photoreceptor surface due to the difference in the moving speed between the developing sleeve and the photoreceptor drum.

The probability of the occurrence of an image defect is determined by the relation between the following factors: the state of coverage of the outer circumferential surface of the developer sleeve by the developer, which relates to how much developer exists on the outer circumferential surface of the developing sleeve in the development region, the peripheral speed ratio (Vr) of the outer circumferential surface of the developing sleeve to the photoreceptor drum surface, and the ratio (Hr) of the height of heads of the magnetic brush layer (Hh) in the development region (hereinafter referred to as "the height of the magnetic brush layer" simply) to the spacing of the outer circumferential surface of the developing sleeve (Hd) to the outer circumferential surface of the photoreceptor drum in the development region.

That is, if too great account is made of the securing of the density in solid areas, and the peripheral speed ratio (Vr) of the outer circumferential surface of the developing sleeve to the photoreceptor drum, the height ratio of the magnetic brush layer (Hr), and the above-mentioned coverage ratio of the magnetic brush layer are made larger excessively, image defects such as unevenness of the density in a half-tone image and scratches in the edge portions tend to occur.

The inventors of the present invention noticed that, for the toner quantity contributing development, not the developer quantity on the surface of the developing sleeve but the quantity of toner that is brought in a state where the toner particles are capable of facing the latent image on the photoreceptor drum is important. That is, it is important how large an area the magnetic brush layer covers of the surface of the developing sleeve in the development region.

Further, the rubbing action by the magnetic brush layer to disturb a toner image, as described in the above, is influenced by the peripheral speed ratio Vr of the developing sleeve to the photoreceptor drum, and also by the height ratio Hr of the magnetic brush layer.

SUMMARY OF THE INVENTION

It is an object of the present invention, in order to solve the above-mentioned problem, to provide an image forming apparatus capable of forming an image securing a high density in solid black areas and having no unevenness of density and no scratch in the edge portions in a half-tone image, by the values of the spacing of the developer carrying member to the image carrying member, the peripheral speed ratio of the developer carrying member to the image carrying member, height of the magnetic brush layer, and the coverage ratio of the magnetic brush layer being made to have a relation with one another.

The object of the present invention can be accomplished by any one of the structures (1) and (2) described below.

(1) An image forming apparatus comprising an image carrying member for forming an electrostatic latent image, a developing device provided with a developer carrying member for carrying a two-component developer containing non-magnetic toner particles and magnetic carrier particles, a magnetic field generating means provided inside said developer carrying member fixedly, and a developer layer regulating member for regulating the height of a magnetic brush layer formed of the two-component developer on said developer carrying member, and a bias voltage applying means for applying a bias voltage composed of a direct-current bias voltage and an alternate-current bias voltage superposed to said developer carrying member, wherein with the peripheral speed ratio of the outer circumferential surface of said developer carrying member to the outer circumferential surface of said image carrying member denoted by Vr, the spacing of the outer circumferential surface of said developer carrying member to the outer circumferential surface of said image carrying member denoted by Hd, the average value of the height of said magnetic brush layer denoted by Hh, the ratio of said average value of the height Hh to said spacing Hd denoted by Hr, and the coverage ratio of the area of said magnetic brush layer to cover the outer circumferential surface of said developer carrying member to the outer circumferential surface of said developer carrying member denoted by $\alpha$%, the relation connecting Vr, Hr, and $\alpha$ is expressed by the following inequality:

$$1 \leq (\alpha/100) \times Vr \times Hr^{1/3} < 3.5.$$

(2) An image forming apparatus as set forth in the structure (1) characterized by the aforesaid two-component developer having a toner concentration expressed by weight percent of 3% to 10% to the developer composed of magnetic carrier particles having a volume-average particle diameter of 30 μm to 60 μm and a saturation magnetization of 30 emu/g to 60 emu/g and non magnetic toner particles having a volume-average particle diameter of 4 μm to 11 μm mixed.

BRIEF DESCRIPTION OF THE DRAWINGS

FIG. 4(*a*) to FIG. 4(*d*) are graphs showing the result of experiments in which the state of occurrence of the three steps of density in a solid black image, and unevenness of density and scratches in edge portions in a half-tone image was investigated;

DETAILED DESCRIPTION OF THE PREFERRED EMBODIMENT

Figure 1:
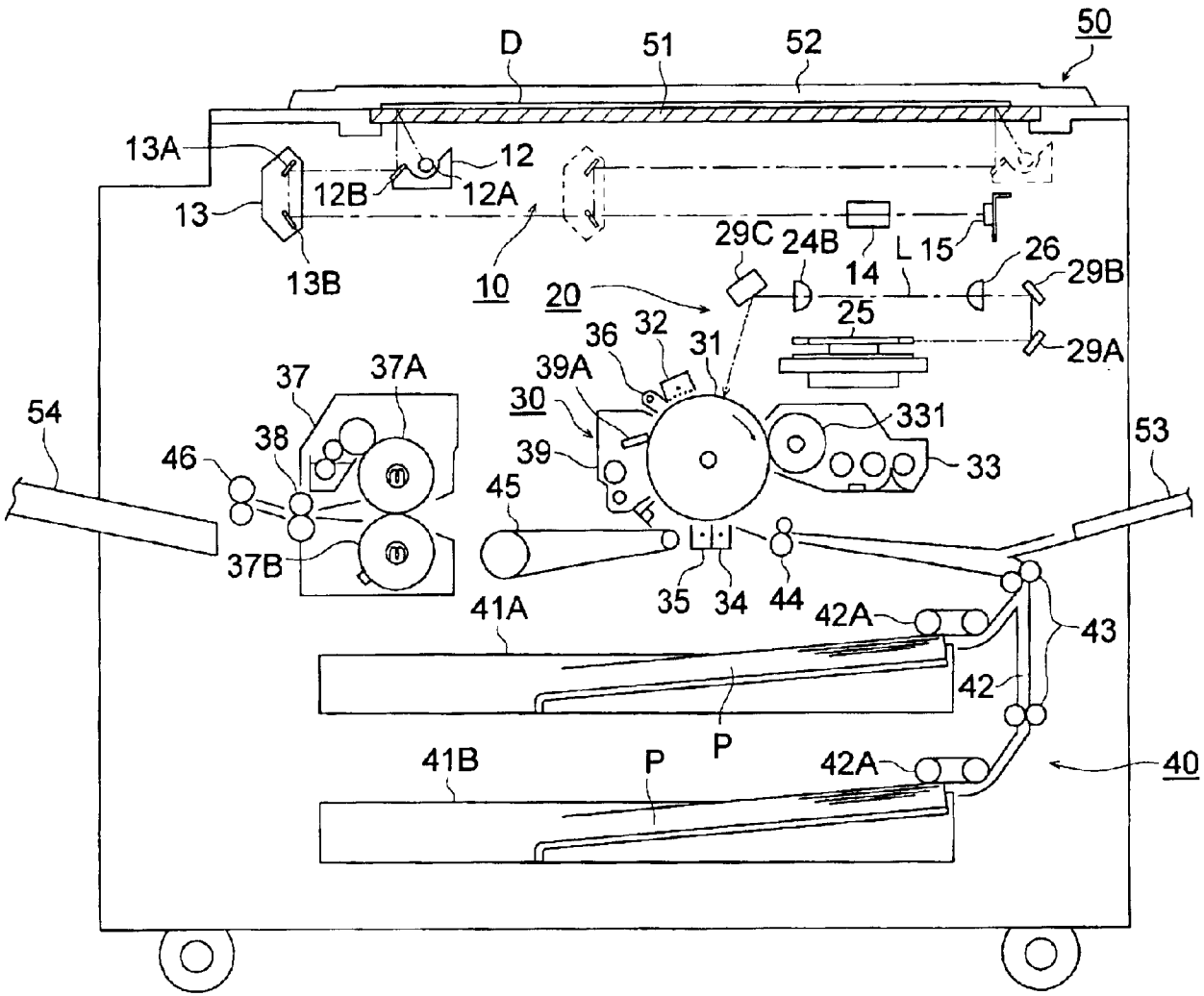
FIG. 1 is an outline structural drawing showing an example of an image forming apparatus of the present invention.

FIG. 1 is an outline structural drawing showing an example of an image forming apparatus of the present invention.

This image forming apparatus is composed of an image reading unit 10, a writing section 20, an image forming section 30, a paper feed section 40, a document placing section 50, and so on.

In the upper part of the image forming apparatus, there is provided the document placing section 50 composed of a document table 51 having a transparent glass plate etc. and a document cover 52 for covering a document D placed on the document table 51, and inside the apparatus mainframe under the document table 51, there is provided the image reading unit 10 having a first mirror unit 12, a second mirror unit 13, a photographing lens 14, an image sensor such as a CCD sensor, etc.

The image of the document D on the document table 51 is illuminated over the whole surface for the scanning of it, by the parallel movement of an illumination lamp 12A and the first mirror unit 12 equipped with a first mirror 12B in the image reading unit 10 from the position shown by the solid line to the position shown by the broken line and the follow movement of the second mirror unit 13 equipped with an integrally built second mirror 13A and third mirror 13B facing each other at a half speed to said first mirror unit 12, and the image is formed on the image sensor 15 through the first mirror 12A, the second mirror 13A, and the third mirror 13B by the photographing lens 14. When the scanning is finished, the first mirror unit 12 and the second mirror unit 13 return to the initial position, and wait until the next image formation.

After the image data obtained through the reading of the image by the image sensor 15 are converted into a digital signal, they are subjected to processing such as an MTF correction and a γ-correction, and are once stored in a storage (not shown in the drawing) as processed image data. Subsequently, the above-mentioned processed image data are read out from the storage by a control of an image recording section (not shown in the drawing), and inputted as an image signal to the writing section 20 for pulse width modulation.

When the above-mentioned image signal is inputted to the writing section 20 (to be described later) by the control of the above-mentioned image recording section, the image forming section 30 starts image recording operation. That is, a photoreceptor drum 31, which is an image carrying member, rotates clockwise as shown by the arrow mark, its charge having been eliminated by the charge eliminating device 36 for eliminating charge by a pre-charging exposure, and is given charge by a charging device 32; then, an electrostatic latent image corresponding to the image of the document D is formed on the photoreceptor drum 31 by a laser beam L through lenses 24B and 26, and mirrors 29A, 29B and 29C in the writing section 20. After that, the above-mentioned electrostatic latent image is subjected to a reverse development with a developer carried on a developing sleeve 331, which is a developer carrying member, having a development bias voltage applied in a developing device 33, to become a visible toner image.

On the other hand, a sheet of transfer paper P of a specified size, which is one of sheets conveyed out one after another from a paper feed cassette 41A or 41B loaded in the paper feed section 40 by a conveying-out roller 42A, is fed through conveyance roller pairs 43 and a guide member 42 towards an image transfer section. The sheet of transfer paper conveyed in this way is fed out onto the photoreceptor drum 31 by a pair of registration rollers 44 operated in synchronism with the toner image on the photoreceptor drum 31. Onto this sheet of transfer paper P, the toner image on the photoreceptor drum 31 is transferred by the action of a transfer device 34, and the sheet, having been detached off the photoreceptor drum 31 by the charge eliminating action of a detaching device 35, is fed through a conveyance belt 45 to a fixing device 37, where the toner image is fused by a heating roller 37A and a pressing roller 37B, and then, the sheet is ejected onto a tray 54 outside the apparatus by ejection roller pairs 38 and 46. Incidentally, 53 denotes a paper feed table for manual feeding.

The above-mentioned photoreceptor drum 31 continues to rotate further, untransferred toner particles remaining on the surface of it being removed for cleaning the photoreceptor drum by a cleaning blade 39A brought in contact with it in a cleaning device 39, and having been subjected to charge elimination by a charge eliminating device 36 again, is given charge by the charging device 32 uniformly, to move to undergo the next image formation process.

In the embodiment of the present invention, after the surface of the photoreceptor drum 31 is uniformly charged to −650 V by the charging device 32 which is provided in the neighborhood of the photoreceptor drum 31, it is irradiated by a laser beam 25 to have a latent image potential Ve varying within a range expressed by $-650<Ve<0$ (V); thus, a latent image is formed. The above-mentioned latent image is subjected to development by the developing device 33 provided with a definite spacing to the photoreceptor drum 31, to become a visible image. The developing sleeve 331 of the developing device 33 rotates with a number of revolutions corresponding to the specified peripheral speed ratio Vr to the photoreceptor drum 31, to supply a sufficient amount of toner successively to the latent image. Further, a high voltage power source is connected to the surface of the developing sleeve 331 made up of a metallic tube, which is kept at a voltage composed of a direct-current component of −500 V and an alternate-current component of 0.5 kHz to 10 kHz and an amplitude of 1.0 kV to 3.0 kV superposed.

Figure 2:
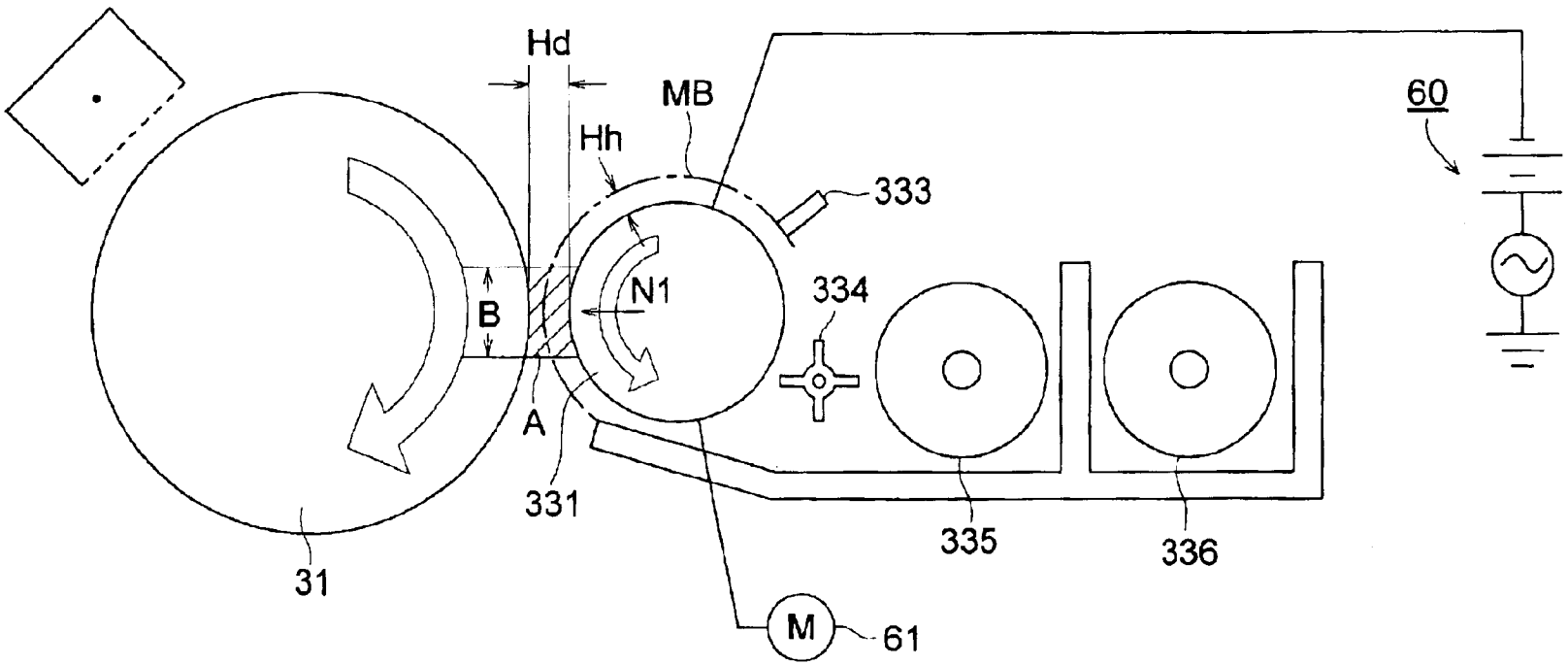
FIG. 2 is a cross-sectional structural drawing showing an example of an image forming apparatus of the present invention.
Figure 3:
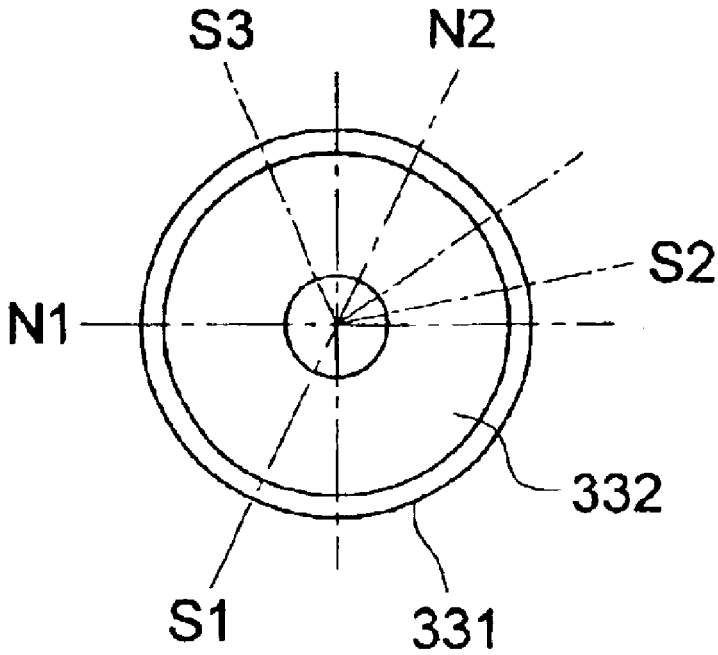
FIG. 3 is a structural drawing of a magnet.

FIG. 2 is a cross-sectional structural drawing showing an example of an image forming apparatus of the present invention, and FIG. 3 is a structural drawing of a magnet.

The structure of this developing device will be explained with reference to FIG. 2 and FIG. 3.

Inside the developing sleeve 331 shown in FIG. 2, as shown in FIG. 3, there is arranged and fixed a magnet roll 332 having a main magnetic pole N1, and magnetic poles S1, S2, N2, and S3 arranged in the counterclockwise direction as magnetic field generating means. The angle made by the line connecting both the centers of the photoreceptor drum 31 and the developing sleeve 331 with the direction of the main magnetic pole N1 (magnet angle) is determined by the developability taken into consideration; in this example of the embodiment, it is determined to be 0°.

The developer in the developing device is supplied to the developing sleeve 331 by a stirring paddle 334, to form a magnetic brush layer with its height regulated by a developer layer regulating plate 333, which is a developer layer regulating member, to an approximately constant height Hh, which is carried to a development region A close to the photoreceptor drum 31 (the hatching portion shown by the width B), to carry out development in a state of contact or non-contact with the photoreceptor drum 31.

Numerals 335 and 336 denote a pair of stirring rollers for stirring the developer.

The developing sleeve 331, which is a developer carrying member, is made up of a non-magnetic cylindrical member made of a stainless steel material having an outer diameter of 8 mm to 60 mm, is kept at a position with a specified spacing to the circumferential surface of the photoreceptor drum 31 by position determining members (not shown in the drawing) provided at both the ends of the developing sleeve 331, and is rotated in the forward direction (counterclockwise direction) with respect to the rotating direction (clockwise direction) of the photoreceptor drum 31. If the outer diameter is not greater than 8 mm, it is possible to form the magnet roll 332 having at least 5 poles composed of the magnetic poles N1, S1, S2, N2, S3 which are necessary for image formation; further, if the outer diameter of the developing sleeve exceeds 60 mm, the developing device 33 becomes large-sized.

The rotation of the developing sleeve 331 is driven by a developing sleeve driving motor 61 of a variable rotation speed type through a rotary shaft and coupling gears (not shown in the drawing); therefore, it is possible to change the value of the above-mentioned peripheral speed ratio Vr.

By a high-voltage power source 60, which is a bias voltage applying means, a bias voltage is applied to the developing sleeve 331 during development, and the developing sleeve 331 is kept at a voltage composed of a direct-current voltage of −500 V and an alternate-current voltage having a frequency of 0.3 kHz to 10 kHz and an amplitude of 1.0 kV to 3.0 kV superposed.

In the development region where the outer circumferential surface of the photoreceptor drum 31 and the outer circumferential surface of the developing sleeve 331 come close to each other, with the spacing from one to the other denoted by Hd, the height of the magnetic brush layer MB (shown in the drawing by the single dot and dash line) formed on the outer circumferential surface of the developing sleeve 331 denoted by Hh, the ratio Hr of the above-mentioned height Hh to the above-mentioned spacing Hd is expressed by Hr=Hh/Hd. That is, the method of development becomes such one that the magnetic brush layer MB is in contact with the photoreceptor drum 31 if the value of the above-mentioned ratio Hr is not less than 1, and it becomes a non-contact one if the value is less than 1.

The height Hh of the magnetic brush layer MB can be changed by the changing of the value of the spacing of the developer layer regulating plate 333 to the outer circumferential surface of the developing sleeve 331, the value of the magnetic force of the magnet roll 332, and the value of the saturation magnetization of the magnetic carrier.

Further, the spacing Hd of the outer circumferential surface of the developing sleeve 331 to the outer circumferential surface of the photoreceptor drum 31 is changed by the adjustment of the position determining members, which are provided at both the end portions of the developing sleeve with respect to the lengthwise direction and brought into contact with a part of the photoreceptor drum 31 or a part of a member to hold the photoreceptor drum 31, through their movement or the replacement by another ones having a different size.

The proportion of the area occupied by the magnetic brush layer (developer) covering the outer circumferential surface of the developing sleeve 331 to the horizontal projection area (having the width B and the length of the developing sleeve) of the outer circumferential surface of the developing sleeve 331 lying within the development region is expressed by the coverage ratio $\alpha$% (the method of measuring the value of $\alpha$ is to be described later in detail), and the ratio of the peripheral speed of the outer circumferential surface of the developing sleeve 331 to the peripheral speed of the outer circumferential surface of the rotating photoreceptor drum 31 is denoted by Vr.

After the investigation of the above-mentioned subject by the use of the above-mentioned image forming apparatus, a result as shown in the graphs of FIG. 4(*a*) to FIG. 4(*d*) was obtained.

FIG. 4(*a*) to FIG. 4(*d*) are graphs showing the result of experiments in which the state of occurrence of the three grades of density in a solid black image, and unevenness of density and scratches in edge portions in a half-tone image was investigated.

First, the signs used in the graphs will be explained.

FIG. 4(*a*), FIG. 4(*b*), and FIG. 4(*c*) are the graphs showing the result of the experiments in which the above-mentioned ratio Hr is set at 1, 0.5, and 1.5 respectively; the ordinate represents the above-mentioned ratio Vr, and the abscissa represents the above-mentioned coverage ratio $\alpha$(%). The signs ●,▲, and X represent the result of the visual judgement for the density in a solid black image being good, medium, and bad respectively. The signs ○, Δ, and X represent the result of the visual judgement for the unevenness of density and scratches in the edge portions in a half-tone image being good, medium, and bad respectively.

FIG. 4(*d*) is a graph showing the synthesis of the results shown in FIG. 4(*a*) to FIG. 4(*c*); the ordinate represents the above-mentioned ratio Hr, and the abscissa represents the value of the product of the above-mentioned ratio Vr multiplied by the coverage ratio $\alpha/100$. The curve C1 shows the border line concerning the result of the judgement for the density in a solid black image being good or bad. The signs ●,▲, and X represent the result of the visual judgement for the density in a solid black image being good, medium, and bad respectively. The curve C2 shows the border line concerning the result of the judgement for the half-tone image being good or bad. The signs ○, Δ, and X represent the result of the visual judgement for the unevenness of density and scratches at the edge portions in a half-tone image being good, medium, and bad respectively. Hence, it can be said that the region lying between these two curves C1 and C2 is the region where both the solid black image and the half-tone image are satisfactory.

If the region lying between the two curves shown in FIG. 4(*d*) is converted into a mathematical expression, the relation connecting Hr, α, and Vr is expressed by the following inequality:

$$1 \leqq (\alpha/100) \times Vr \times Hr^{1/3} < 3.5.$$

By the changing and adjusting of the values of the above-mentioned ratios Hr and Vr, and the above-mentioned coverage ratio α, it is possible to make both the image quality of a solid black image and a half-tone image satisfactory.

Figure 5:
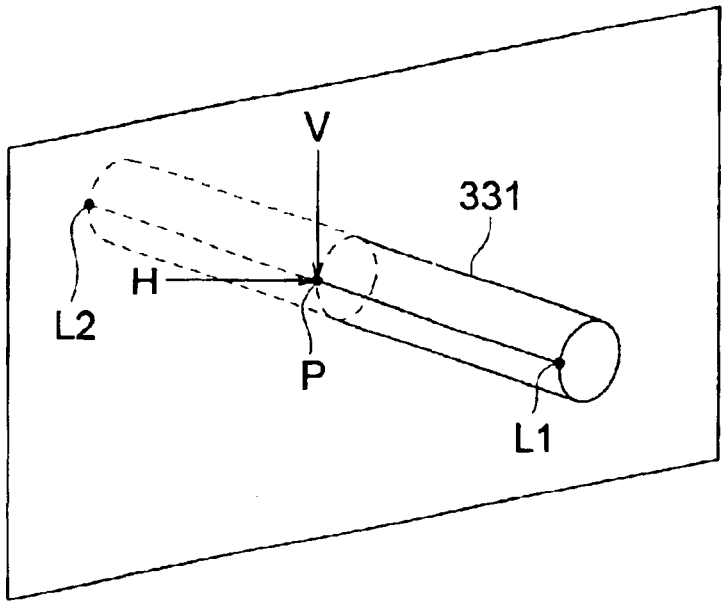
FIG. 5 is a perspective view of a developing sleeve for illustrating the measuring direction of coverage ratio and the height of a magnetic brush layer.
Figure 6:
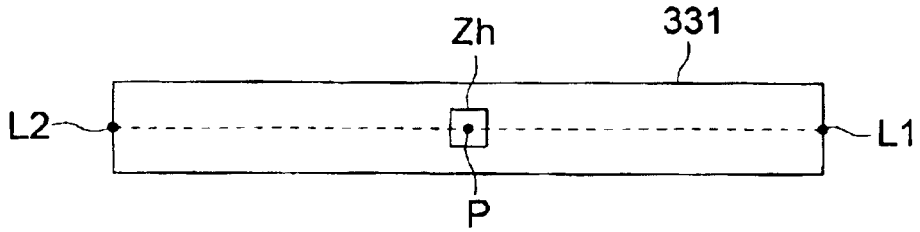
FIG. 6 is the front view of a developing sleeve showing the place to be photographed of a magnetic brush layer for the calculation of coverage ratio.
Figure 7:
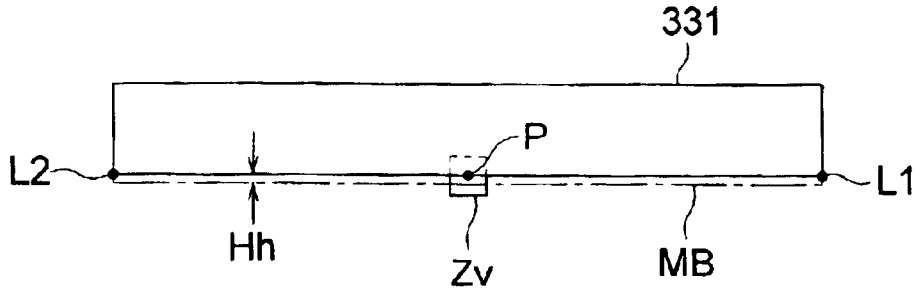
FIG. 7 is the top view of a developing sleeve showing the place to be photographed for the measurement of the height of a magnetic brush layer.
Figure 8:
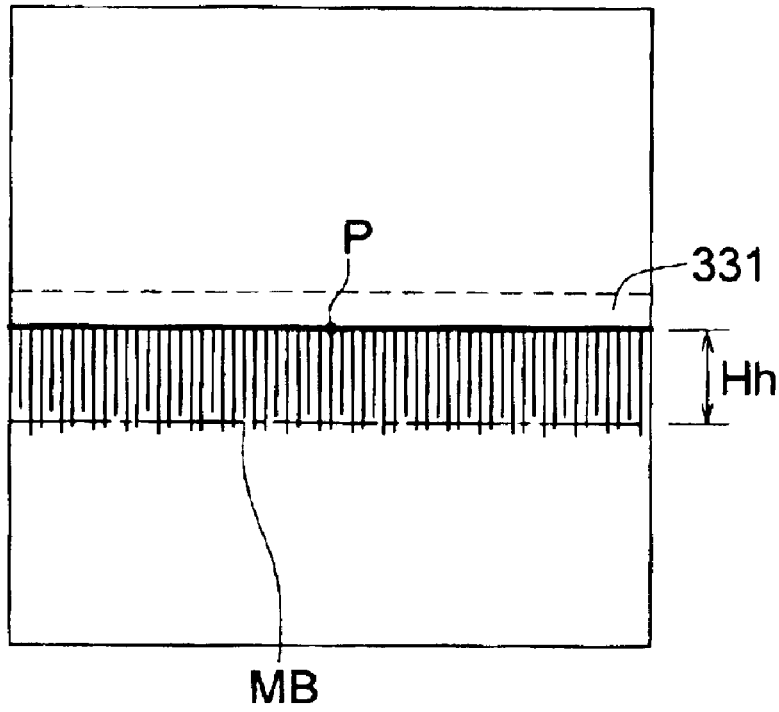
FIG. 8 is an outline drawing for illustrating a method for obtaining the average value Hh of the height of a magnetic brush layer from a photograph of the region Zv shown in FIG. 7.

FIG. 5 is a perspective view of a developing sleeve for illustrating the measuring direction of coverage ratio α and the height of a magnetic brush layer Hh. FIG. 6 is the front view of a developing sleeve showing the place to be photographed of a magnetic brush layer for the calculation of coverage ratio α. FIG. 7 is the top view of a developing sleeve showing the place to be photographed for the measurement of the height of a magnetic brush layer Hh. FIG. 8 is an outline drawing of a photograph of the region Zv shown in FIG. 7.

In the following, the method of measuring the value of coverage ratio α will be explained.

The value of coverage ratio α is calculated in the following way. That is, a plurality of places on the developing sleeve are photographed from the H direction in the drawing (horizontal direction) by a digital camera, and the image data obtained for the developer forming the magnetic brush layer (black) and the surface of the developing sleeve (white) in the development region A are binarized and analyzed for each place. Thus, the value of the coverage ratio α is obtained as the average of the values of the ratio of the number of pixels of "0" to the total number of pixels over the plural places.

In FIG. 5, the outer circumferential surface of the developing sleeve 331 is in the state that a magnetic brush layer of the developer (not shown in the drawing) is formed on the surface, and the line segment L1–L2 connecting the points at plural places to be photographed by a digital camera from the H direction is a straight line which is parallel to the rotary axis and coincides with the straight line on the developing sleeve 331 at a position closest to the photoreceptor drum 31.

In this example, a microscope system VT6300 manufactured by Keyence Co., Ltd. is used in photographing. As shown in FIG. 6, for the magnetic brush layer on the outer circumferential surface of the developing sleeve, the region Zh of 5 mm square centering on the photographing point P on the above-mentioned straight line L1–L2 is photographed from the H direction with a visual field of 40 magnifications.

As regards the condition of illumination, the development region A is illuminated through optical fibers of a microscope VH-Z25 manufactured by the same company Keyence Ltd. from the direction of the circumference. And photographing is made with the light quantity of the light source adjusted in such a way that the value of the illuminance of a white reference plate placed at the focal position measured by means of a Spotmeter manufactured by PENTAX Corp. becomes 16 to 17 EV.

The data of an image obtained at this time with a highest resolution are stored as compressed by an electronic file. The stored image data are opened by means of an application software Photoshop prepared by Adobe Corp. and are subjected to binarization.

As regards the method of binarization, the brightness of the outer circumferential surface of the developing sleeve under the above-mentioned photographing environment is represented as divided into 256 levels. And a threshold value is determined, in order to make the presence or absence of the developer region to agree with the visual recognition, at a level darker than the brightness level at portions where no magnetic brush layer is present by 20–30 levels. With respect to the binarized image data, the ratio of the number of pixels in the dark portion (the range where the magnetic brush layer is present) to the total number of pixels of the observation region is α.

Next, the method of measuring the height of a magnetic brush layer will be explained.

In FIG. 5, in the same way as the above-mentioned photographing from the H direction, photographing is made from the V direction, the vertically upper direction with respect to the above-mentioned photographing point P. The photographing point P, as shown in FIG. 7, is a point located at the center of the region Zv of 5 mm square on the horizontal plane including the straight line L1–L2 on the outer circumferential surface of the developing sleeve 331, and in said region Zv, the straight line MB representing the height of the magnetic brush layer Hh as shown by the single dot and dash line.

FIG. 8 is an outline drawing for illustrating the method of obtaining the average value Hh of the height of a magnetic brush layer from a photograph of the above-mentioned region Zv, by a line being drawn for the average of the height values of the heads of the magnetic brush layer having a dispersion, the height of the magnetic brush layer Hh from the outer circumferential surface of the developing sleeve 331 can be determined.

In this example, as regards the developer used, it is a two-component developer containing a magnetic carrier mixed with a non-magnetic toner of 3% to 10% by weight; for the magnetic carrier, one having a volume-average particle diameter of 30 μm to 60 μm, and a saturation magnetization of 30 emu/g to 60 emu/g is used, and for the non-magnetic toner, one having a volume-average particle diameter of 4 μm to 11 μm is used.

By the present invention, by the values of the spacing of the developer carrying member to the image carrying member, the peripheral speed ratio of the former to the latter, the height of the magnetic brush layer, and its coverage ratio being made to have a relation with one another, it is possible to provide an image forming apparatus capable of forming a solid black image securing the density and a half-tone image having no unevenness of density and no scratches in edge portions.

What is claimed is:

1. An image forming apparatus comprising:

(a) an image carrying member for forming an electrostatic latent image; and (b) a developing device having a developer carrying member for carrying a two-component developer containing non-magnetic toner particles and magnetic carrier particles, a magnetic field generator provided inside the developer carrying member stationary, and a developer layer regulating member for regulating a height of a magnetic brush layer formed of the two-component developer on the developer carrying member, and a bias voltage applying device for applying a bias voltage composed of a direct-current bias voltage and an alternate-current bias voltage which is superposed on the direct-current bias voltage, to the developer carrying member, wherein the following condition is satisfied, $$1 \leqq (\alpha/100) \times Vr \times Hr^{1/3} < 3.5$$

where Vr represents a peripheral speed ratio of an outer circumferential surface of the developer carrying member to an outer circumferential surface of the image carrying member, Hd represents a spacing of the outer circumferential surface of the developer carrying member to the outer circumferential surface of the image carrying member, Hh represents an average value of a height of the magnetic brush layer, Hr represents a ratio of the average value of the height Hh to the spacing Hd, and $\alpha$ represents a coverage ratio of an area of the magnetic brush layer to cover the outer circumferential surface of the developer carrying member to the outer circumferential surface of the developer carrying member.

2. The image forming apparatus of claim 1, wherein the two-component developer has a toner concentration expressed by 3% to 10% by weight to a developer composed of magnetic carrier particles having a volume-average particle diameter of 30 $\mu$m to 60 $\mu$m and a saturation magnetization of 30 emu/g to 60 emu/g and non magnetic toner particles having a volume-average particle diameter of 4 $\mu$m to 11 $\mu$m, which are mixed with the magnetic carrier particles.

* * * * *